US007562606B2

(12) United States Patent
Grand et al.

(10) Patent No.: US 7,562,606 B2
(45) **Date of Patent: *Jul. 21, 2009**

(54) MULTI-BIT DRIVER WITH REMOVABLE AND REPLACEABLE TOOL BITS

(75) Inventors: Gerard Grand, St. Catharines (CA); Yiu Cheuk Guang, Hong Kong (HK); Christopher Wu, Oakville (CA)

(73) Assignee: Dragonfire Group Holdings Limited, Causeway Bay (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/353,991

(22) Filed: Feb. 15, 2006

(65) Prior Publication Data

US 2007/0251358 A1 Nov. 1, 2007

Related U.S. Application Data

(60) Provisional application No. 60/653,206, filed on Feb. 15, 2005.

(51) Int. Cl.
*B25B 23/00* (2006.01)
*B25G 1/08* (2006.01)

(52) U.S. Cl. ..... 81/439; 81/490; 81/177.4

(58) Field of Classification Search ..... 81/439, 81/490, 177.4
See application file for complete search history.

(56) References Cited

U.S. PATENT DOCUMENTS

| | | | | | |
|---|---|---|---|---|---|
| 2,629,413 | A * | 2/1953 | Stettler | ..... | 81/490 |
| 2,635,661 | A * | 4/1953 | Egan | ..... | 81/490 |
| 3,426,813 | A * | 2/1969 | Robertson | ..... | 81/490 |
| 3,750,729 | A | 8/1973 | Lemieux | | |
| 4,572,038 | A * | 2/1986 | Graham | ..... | 81/439 |
| 4,762,036 | A * | 8/1988 | Orlitzky et al. | ..... | 81/437 |
| 5,325,745 | A * | 7/1994 | Koehler | ..... | 81/439 |
| 5,526,721 | A | 6/1996 | Waosvosz | | |
| 5,673,600 | A | 10/1997 | Yamauchi | | |
| 6,205,893 | B1 | 3/2001 | Sato | | |
| 6,332,384 | B1 * | 12/2001 | Cluthe | ..... | 81/490 |
| 6,601,483 | B2 * | 8/2003 | Wannop | ..... | 81/490 |
| 7,188,555 | B2 * | 3/2007 | Beauchamp | ..... | 81/439 |
| 7,287,451 | B2 * | 10/2007 | Rodgers | ..... | 81/439 |
| 2002/0007705 | A1 | 1/2002 | Beauchamp | | |
| 2008/0041194 | A1 * | 2/2008 | Beauchamp | ..... | 81/177.4 |

OTHER PUBLICATIONS

International Preliminary Report on Patentabilitywith Written Opinion, PCT/CA2004/000582, mailed Jan. 9, 2004.

International Search Report, PCT/CA2004/000582, mail date Jan. 9, 2004.

* cited by examiner

*Primary Examiner*—David B Thomas
(74) *Attorney, Agent, or Firm*—Woodard, Emhardt, Moriarty, McNett & Henry LLP

(57) ABSTRACT

A multi-bit driver comprises a housing and a plurality of bit assemblies operatively retained within the housing. At least one of the bit assemblies has a base portion and a tool bit member removably and replaceably mountable on the base portion. A bit chuck in the housing is for receiving each tool bit member singularly in torque transmitting relation, and includes a bit-receiving opening for permitting each tool bit member singularly to extend therethrough. The housing includes a substantially transparent forward portion that permits viewing of the tool bit members. An actuator extends from each bit assembly exteriorly to the housing for operative engagement by a user, for co-operative movement of the actuator means and the bit assembly between a retracted configuration, a forwardly extended in-use configuration.

26 Claims, 16 Drawing Sheets

MULTI-BIT DRIVER WITH REMOVABLE AND REPLACEABLE TOOL BITS

FIELD OF THE INVENTION

The present invention relates to multi-bit drivers and more particularly relates to multi-bit drivers, wherein the tool bits are slidably retained within the main housing, are selected for use using a forward manual action by a user, and are retracted by a rearward manual action by a user.

BACKGROUND OF THE INVENTION

Many different types of multi-bit drivers are now available on the market. Recent types of multi-bit drivers have bit assemblies that are mounted in sliding relation in a housing such that an external button is slid forwardly along the slot to present a single bit for use, extending outwardly from a bit chuck.

Typically, such multi-bit drivers are quite convenient to use since it is quick and easy to change between bits; however, they have a definite limitation in that only a fixed number of tool bits, typically six tool bits, can be fit into the housing of the driver. If a user needs another size or type of tool bit other than the ones that are included with the multi-bit driver, another tool must be used, which is inconvenient.

U.S. Pat. No. 6,332,384 issued Dec. 25, 2001, to Cluthe, discloses a multi-bit screwdriver wherein a plurality of bit assemblies are slidably mounted within the housing of a screwdriver. Each bit assembly has a fixed tool bit and a bit extension pivotally connected at a front end to the back end of the tool bit. A disc shaped actuator button disposed at the back end of the bit extension is disposed exteriorly to the housing for selective manual manipulation of the bit assembly. When a bit assembly is slid into a forwardly extended in-use position, a locking element engages a groove in the tool bit to lock it in place. Unfortunately, none of the tool bits are removable and replaceable. The Cluthe multi-bit screwdriver as described above is marketed under the name RETRACT-A-BIT™. Also, a very similar but slightly more advanced version multi-bit screwdriver is marketed under the name RETRACT-A-BIT™ PRO.

It is an object of the present invention to provide a multi-bit driver that is not limited to a pre-determined number of driver bits.

It is an object of the present invention to provide a multi-bit driver that is not limited to a pre-determined number of driver bits, wherein the tool bits are removable and replaceable.

SUMMARY OF THE INVENTION

In accordance with one aspect of the present invention there is disclosed a novel multi-bit driver comprising a housing and a plurality of bit assemblies operatively retained within the housing, each bit assembly having a tool bit member. At least one of the plurality of bit assemblies has a base portion and a tool bit member removably and is replaceably mountable on the base portion. A bit chuck is disposed at one end of the housing for receiving each tool bit member singularly in torque transmitting relation, and includes a bit-receiving opening for permitting each tool bit member singularly to extend therethrough. An actuator means extends from each the bit assembly exteriorly to the housing for operative engagement by a user, for co-operative movement of the actuator means and the bit assembly between a retracted configuration, a forwardly extended in-use configuration whereat the bit assembly is positioned such that the tool bit member extends outwardly from the housing through the opening of the bit chuck, and back to the retracted configuration. There are means to retain the bit assemblies in the forwardly extended in-use configuration.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the multi-bit driver according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. The invention will now be described by way of example with reference to the following drawings in which.

DETAILED DESCRIPTION OF THE PREFERRED EMBODIMENTS

Figure 10:
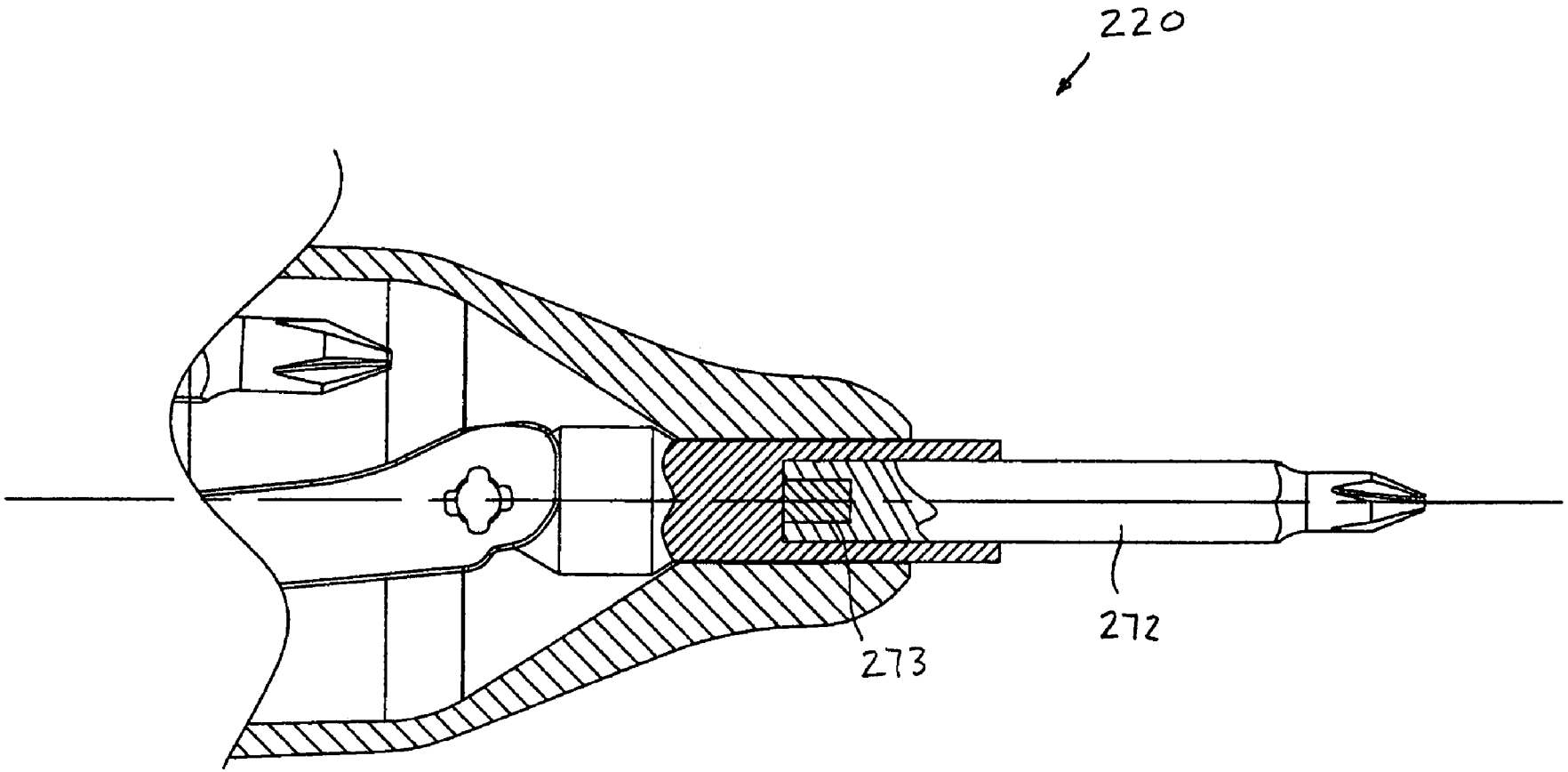
FIG. 10 is an enlarged cut-away side elevational view of a second preferred embodiment multi-bit driver according to the present invention.
Figure 11:
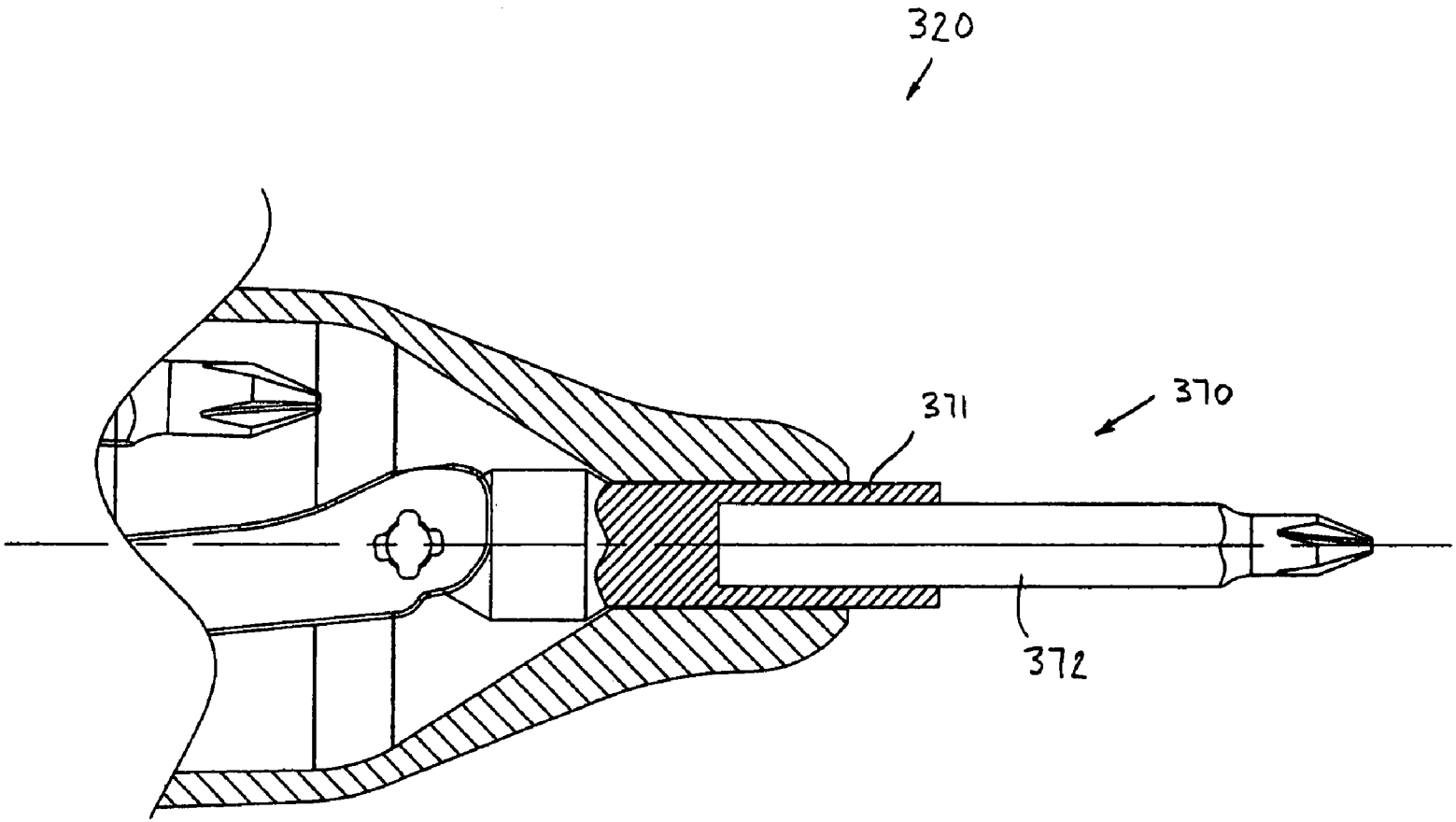
FIG. 11 is a cut-away side elevational view of a third preferred embodiment multi-bit driver according to the present invention.
Figure 12:
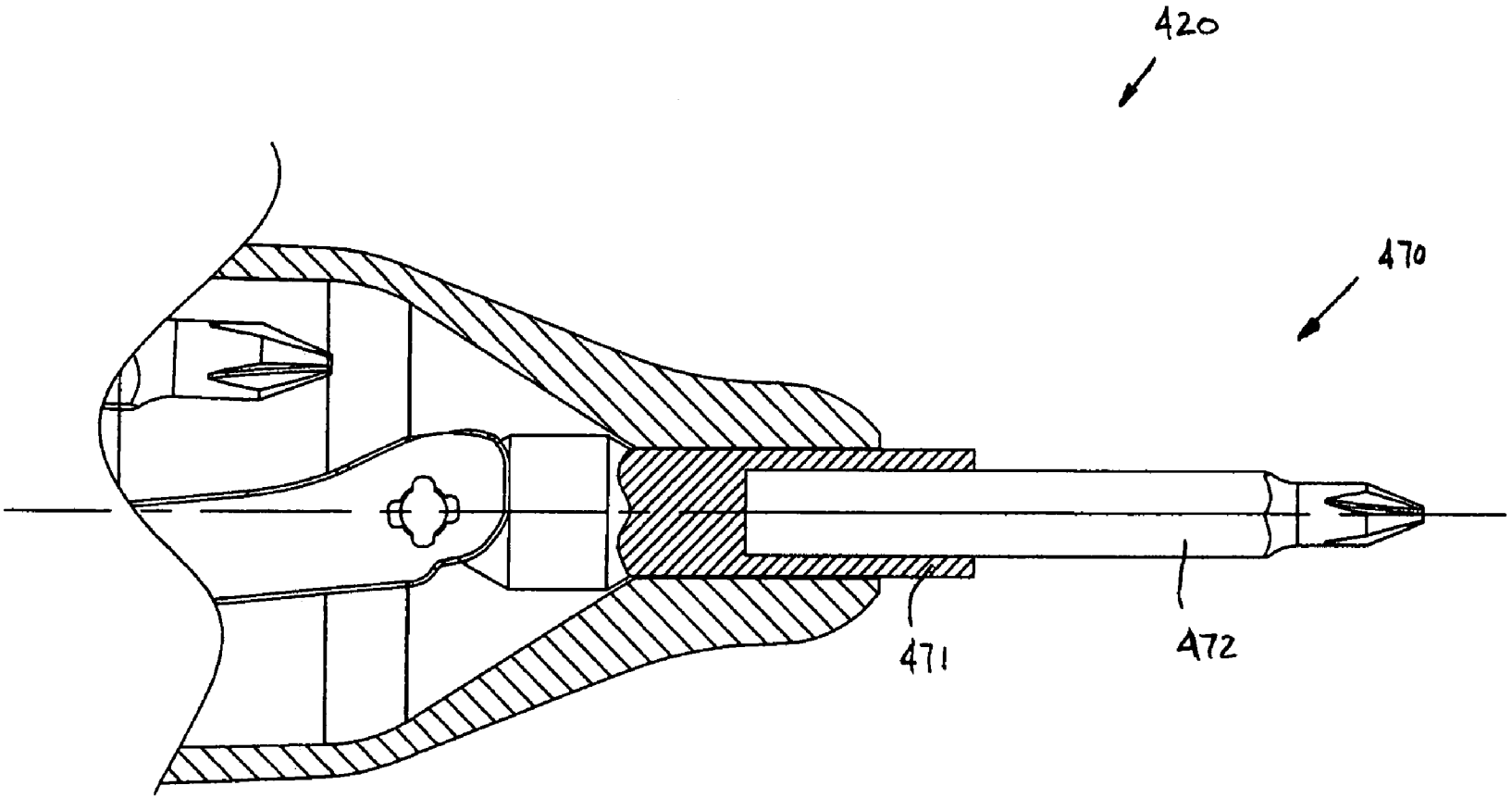
FIG. 12 is a cut-away side elevational view of a fourth preferred embodiment multi-bit driver according to the present invention.
Figure 13:
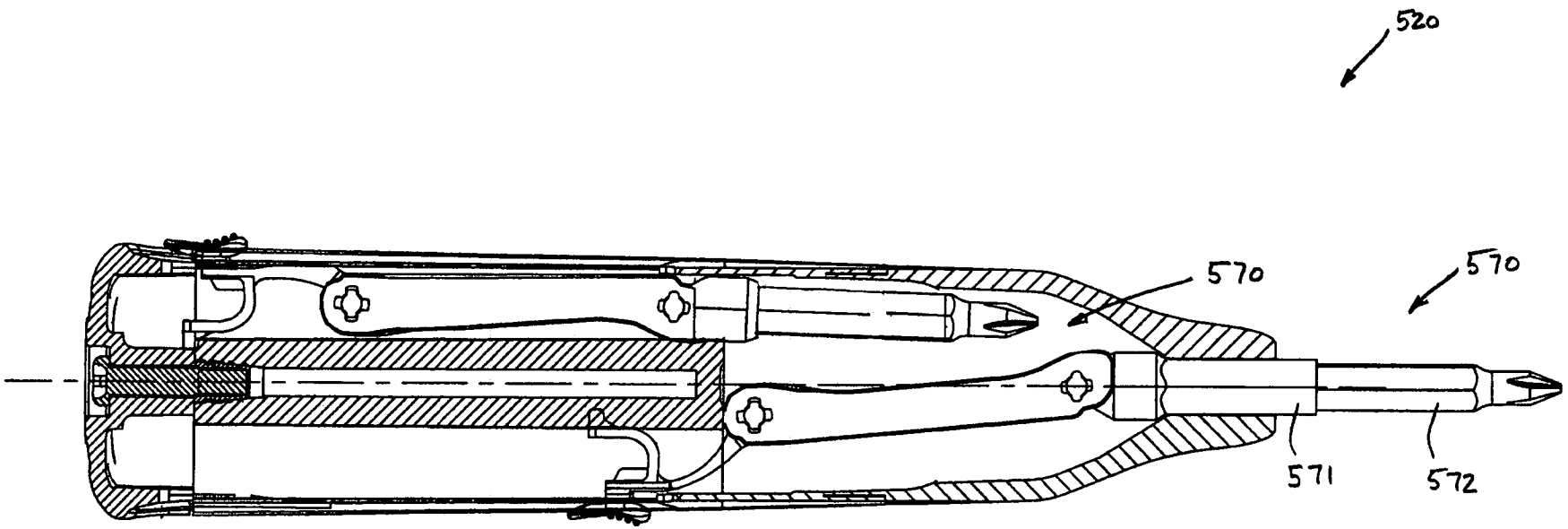
FIG. 13 is a cut-away side elevational view of a fifth preferred embodiment multi-bit driver according to the present invention.
Figure 14:
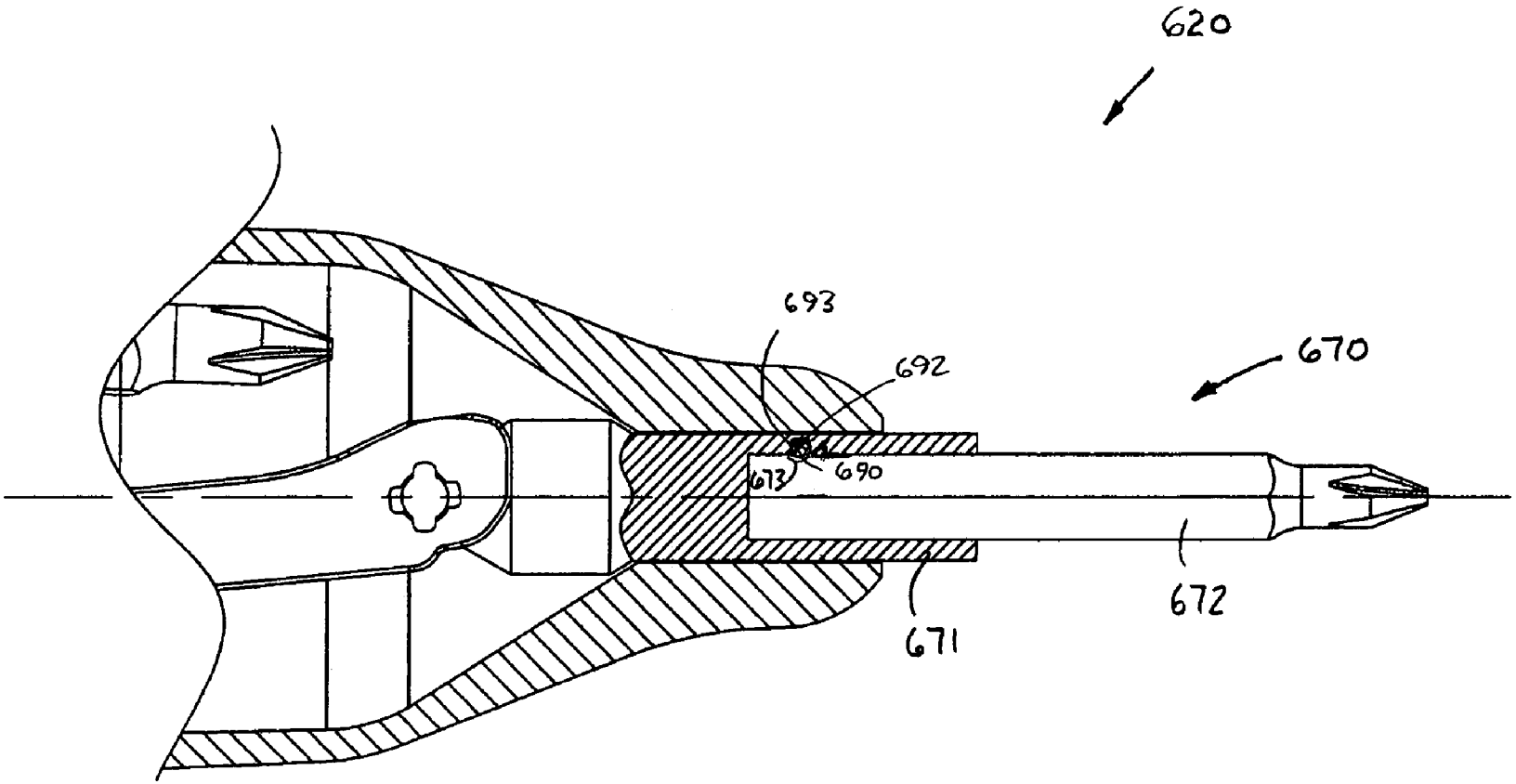
FIG. 14 is a cut-away side elevational view of a sixth preferred embodiment multi-bit driver according to the present invention.
Figure 15:
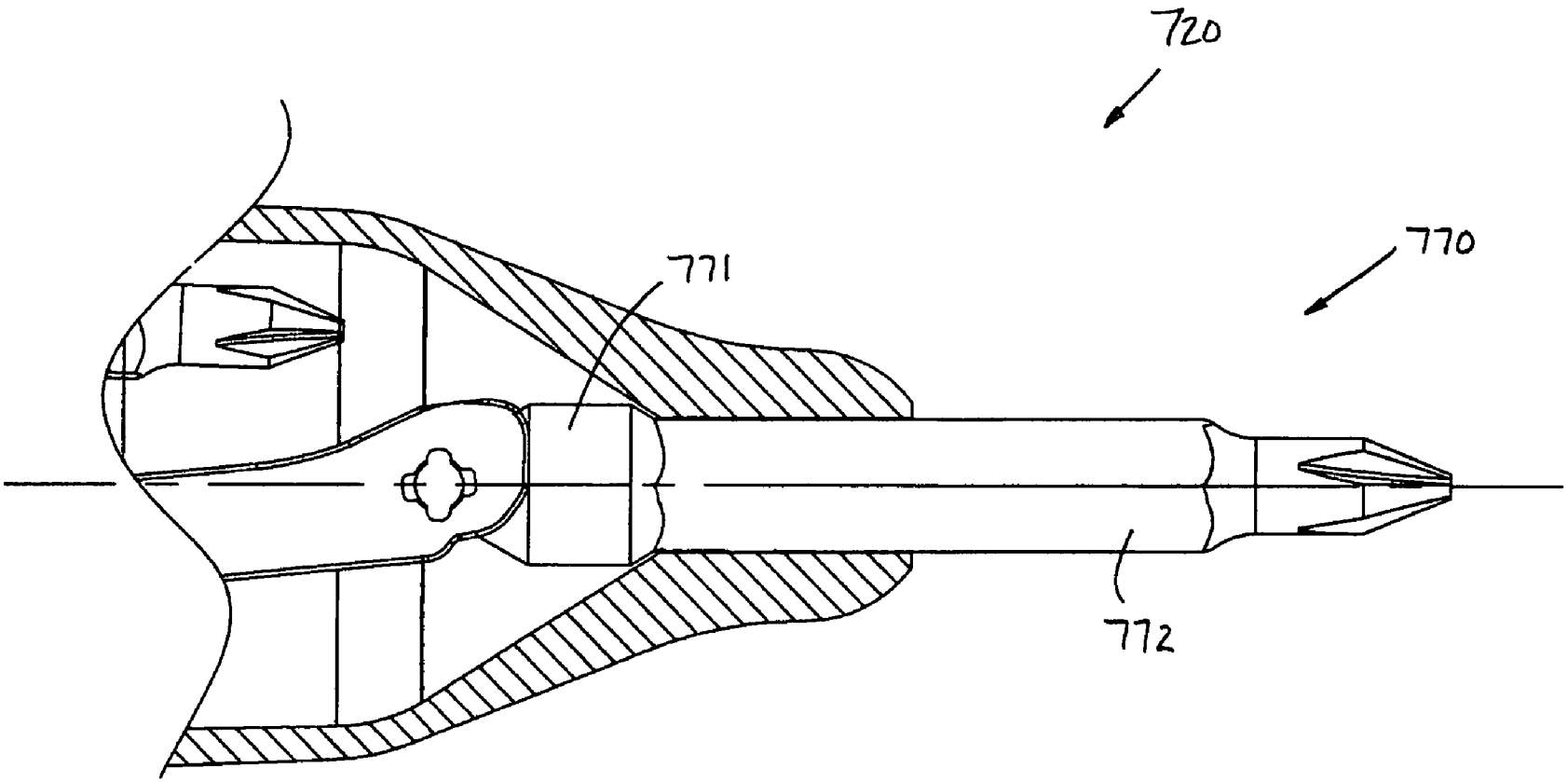
FIG. 15 is a cut-away side elevational view of a seventh preferred embodiment multi-bit driver according to the present invention; and, FIG. 16 is a cut-away side elevational view similar to FIG. 15, but with the base portion of the bit assembly shown partially cut away.
Figure 16:
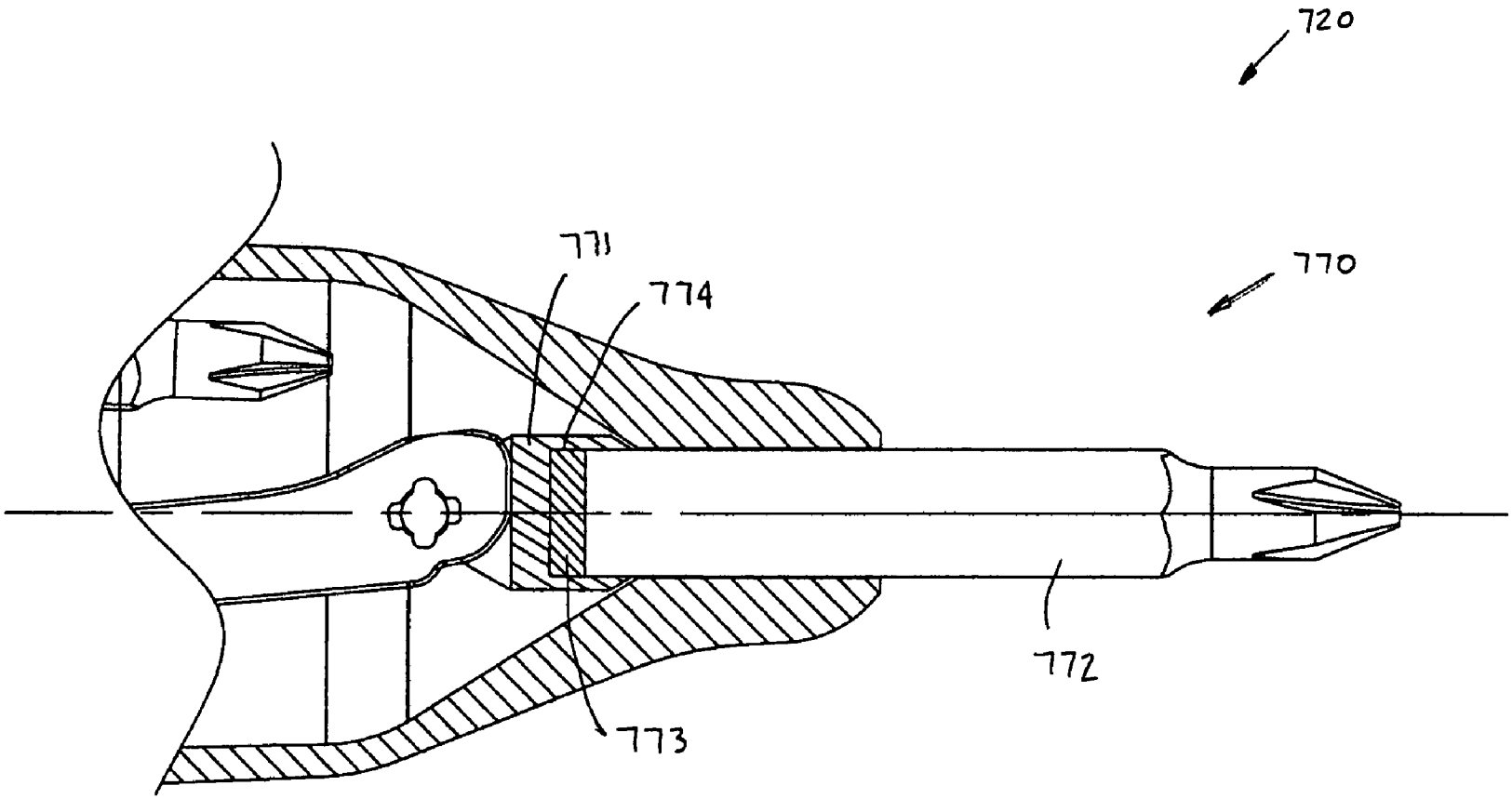

Referring to FIGS. 1 through 16 of the drawings, it will be noted that FIGS. 1 through 9 illustrate the first preferred embodiment of the multi-bit driver of the present invention, FIG. 10 illustrates the second preferred embodiment of the multi-bit driver of the present invention, FIG. 11 illustrates the third preferred embodiment of the multi-bit driver of the present invention, FIG. 12 illustrates the fourth preferred embodiment of the multi-bit driver of the present invention, FIG. 13 illustrates the fifth preferred embodiment of the multi-bit driver of the present invention, FIG. 14 illustrates the sixth preferred embodiment of the multi-bit driver of the present invention, and FIGS. 15 and 16 illustrate the sixth preferred embodiment of the multi-bit driver of the present invention.

Reference will now be made to FIGS. 1 through 9, which show a first preferred embodiment of the multi-bit driver of the present invention, as indicated by general reference numeral 20. The multi-bit driver 20 comprises a housing 30 defining a longitudinal axis AL@, and a handle portion 40, a central transition portion 50, and a cone portion 60. The housing 30 tapers at the cone portion 60 from the central transition portion 50 to a bit chuck 62 that will be described in greater detail subsequently. Alternatively, the central transition portion 50 and the cone portion 60 could be one integral piece. The housing 30 also comprises a longitudinally directed central column 32 disposed within the housing 30. A plurality of channels 34, specifically six in the preferred embodiment, surround and define the central column 32.

An end cap 28 is secured onto the back end of the housing 30 by means of a threaded fastener 31 that engages a co-operating bore hole 33 in the central column 32.

A plurality of bit assemblies, as indicated by the general reference numeral 70, specifically six bit assemblies 70 in the preferred embodiment, are operatively retained within the housing 30. The bit assemblies 70 each have an actuator attached thereto. Each bit assembly 70 has a tool bit member 72 at its front end and a bit extension 80 at its back end. The bit extension 80 is operatively attached in hinged relation, and preferably pivotally attached to the tool bit member 72. Alternatively, a living hinge arrangement could be used to operatively attach in hinged relation the bit extension 80 to the tool bit member 72. Alternatively, the tool bit member 72 and the bit extension 80 could be joined to form a single unit alternative embodiment bit assembly, such that the bit extension portion of the bit assembly or the joint or both is sufficiently flexible in the radial direction and rigid enough to reduce its degree of freedom.

Another important feature of the present invention is that the housing 30 comprises a substantially transparent forward portion that permits viewing of the tool bit members 72. In the first preferred embodiment as illustrated, the substantially transparent forward portion is the cone portion 60 that extends from the central transition portion 50 to the bit chuck 62.

Each bit extension 80 has a contact surface 82 at a back end 86, as will be discussed in greater detail subsequently, and is made from a suitable rigid material such as aluminum, cold rolled steel, plastic, and so on.

Each tool bit member 72 has a first stop surface 74 and each bit extension 80 has a second stop surface 81, and defines a longitudinal tool bit axis AT@. Further, each tool bit member 72 comprises an overmolded plastic back end portion 76. The tool bit member 72 is pivotally attached at its overmolded plastic back end portion 76 to the bit extension 80 for pivotal movement about a pivot axis AP@ oriented substantially transversely to the longitudinal tool bit axis AT@. In the forward-oriented angular position, the first and second stop surfaces 74, 81 abut against each other in force transmitting relation, as will be discussed in greater detail subsequently.

Figure 1:
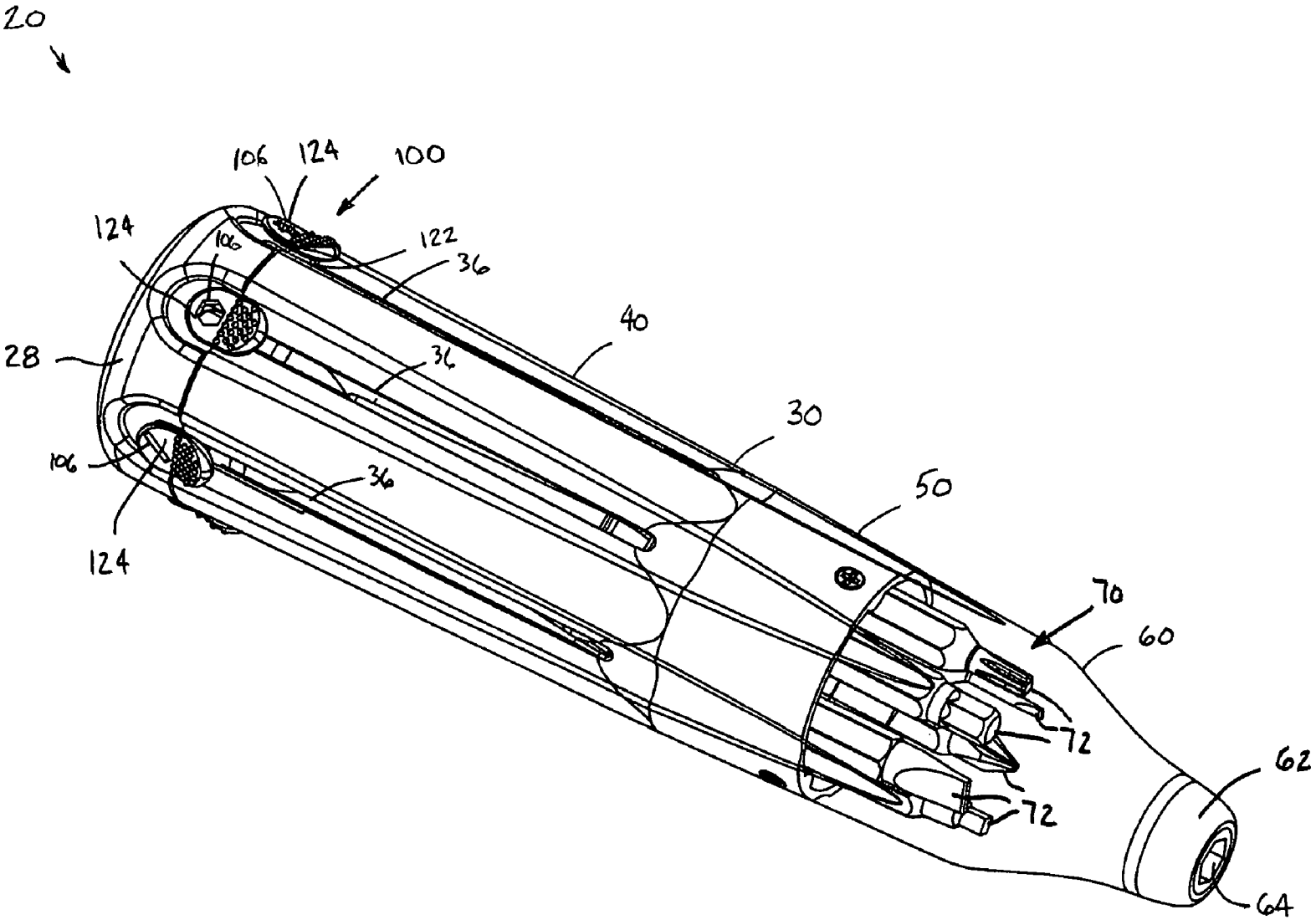
FIG. 1 is a perspective view from the front of the first preferred embodiment multi-bit driver according to the present invention, with all of the bit assemblies in a retracted configuration.
Figure 2:
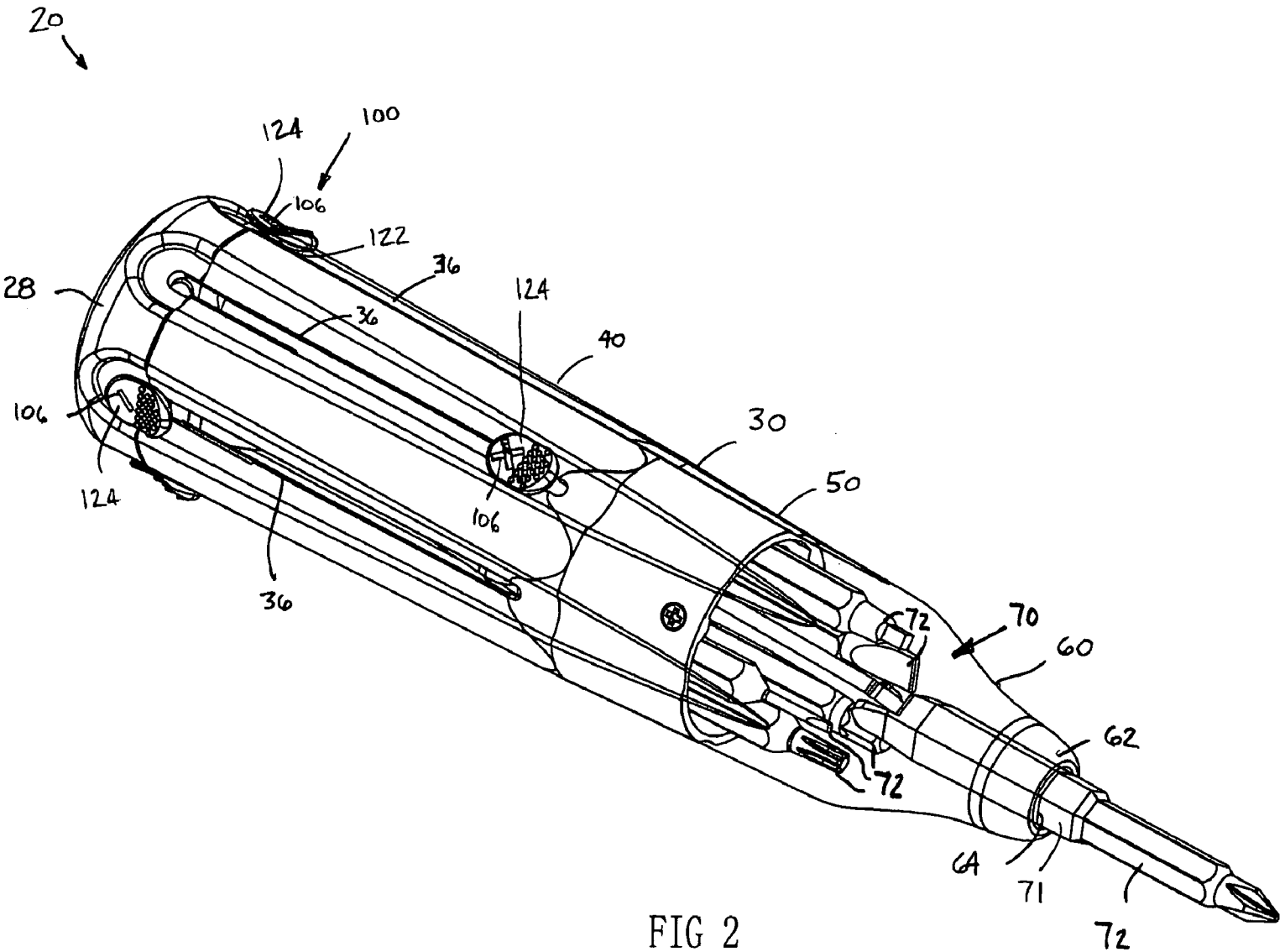
FIG. 2 is a perspective view of the multi-bit driver of FIG. 1, but with a selected bit assembly in a forwardly extended in-use configuration.
Figure 3:
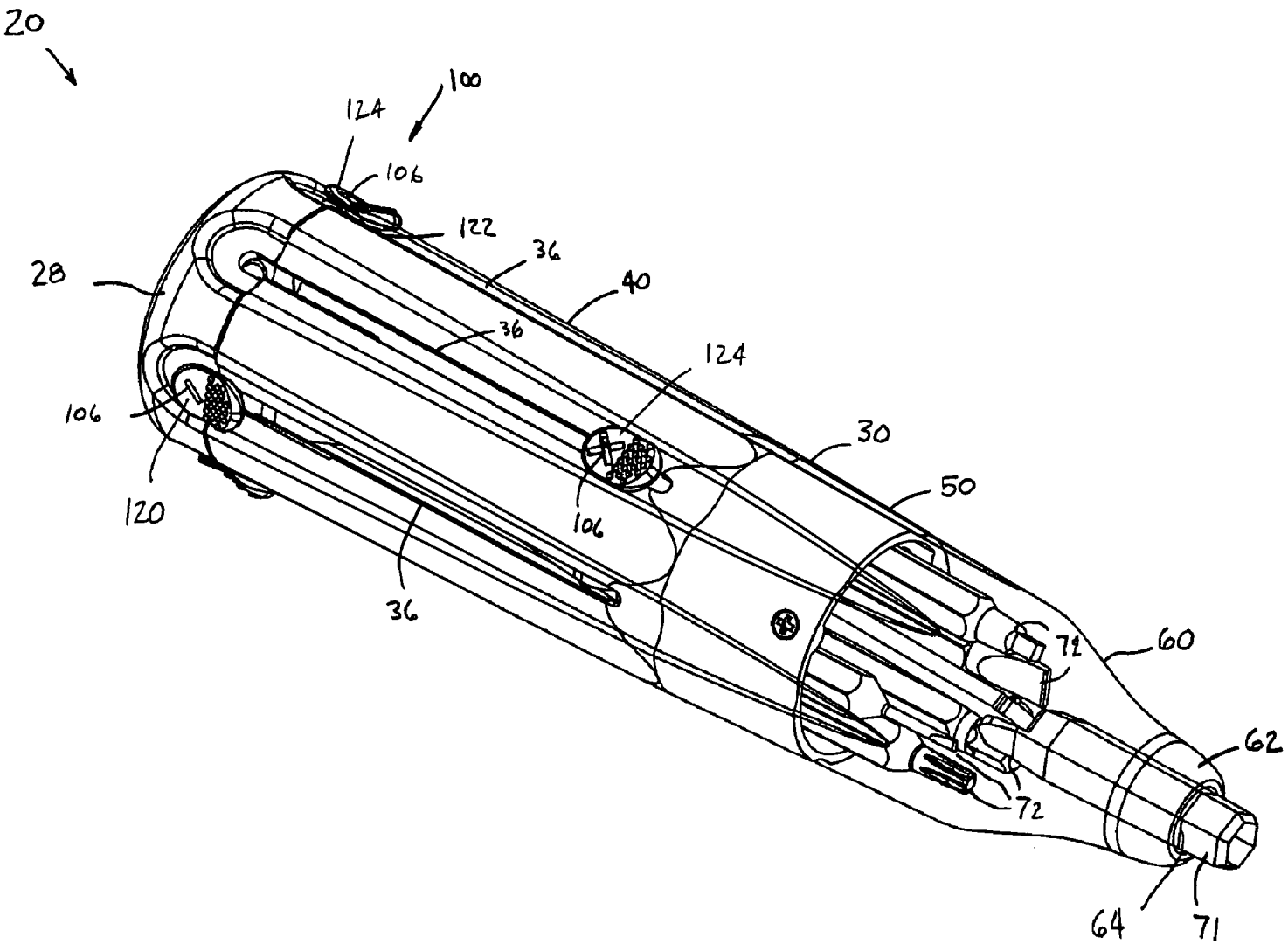
FIG. 3 is a perspective view of the multi-bit driver of FIG. 2, but with the tool bit member removed from the base portion of the bit assembly.
Figure 4:
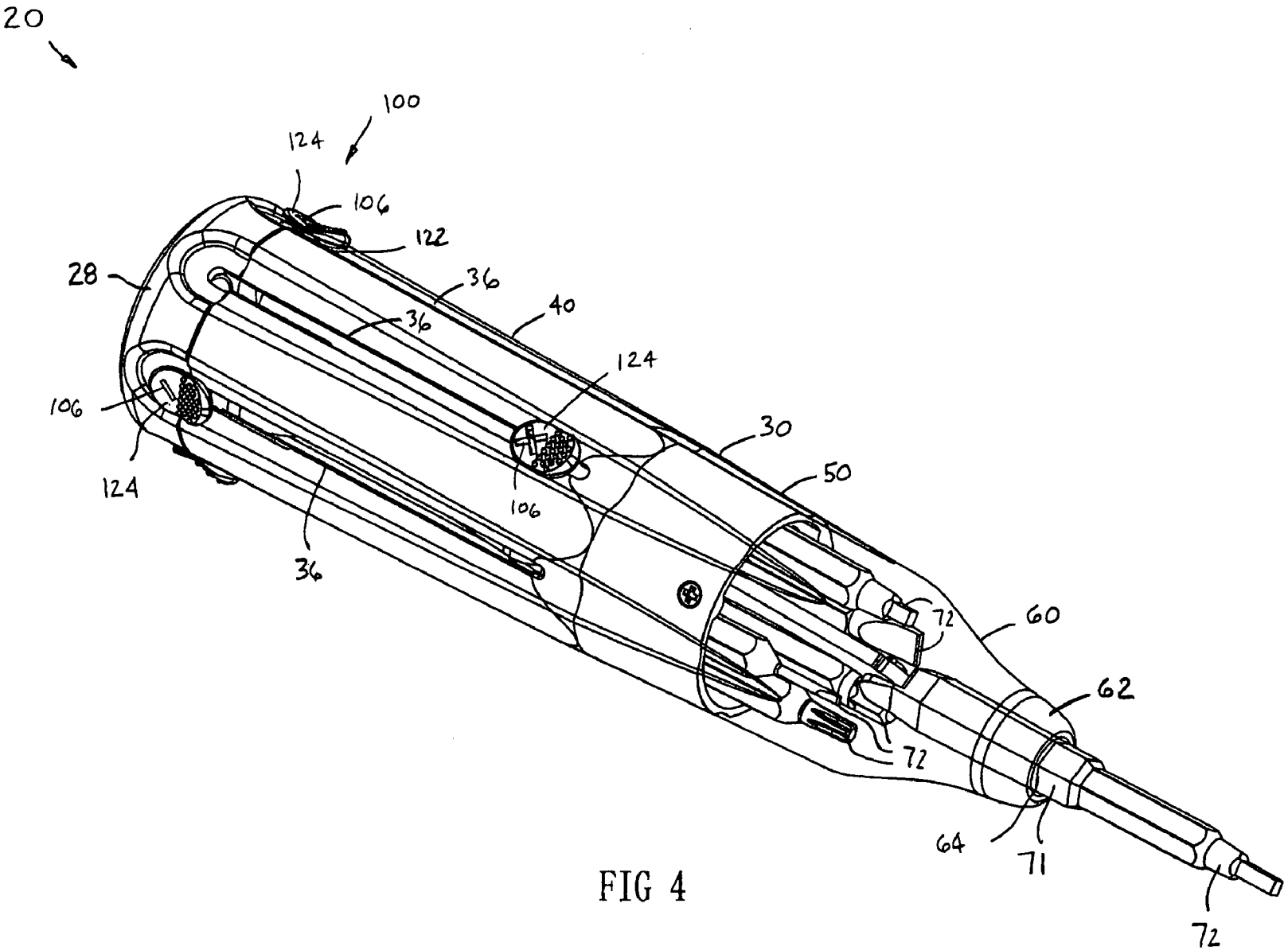
FIG. 4 is a perspective view similar to FIG. 2, but with another tool bit member installed in the base portion of the bit assembly.
Figure 5:
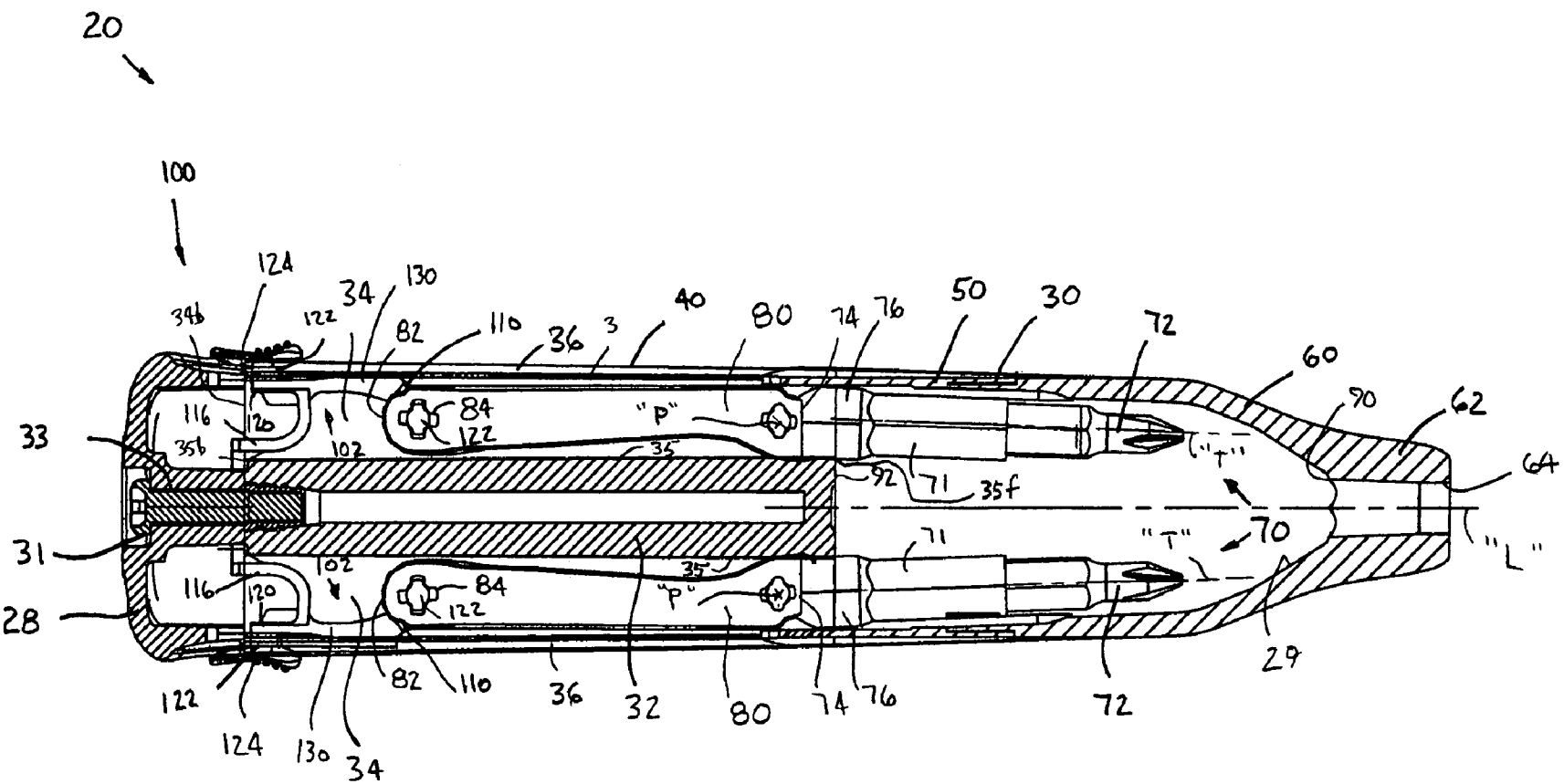
FIG. 5 is a cross-sectional side elevational view taken along section line A-A of FIG. 1, showing the bit assemblies in their retracted configuration.
Figure 6:
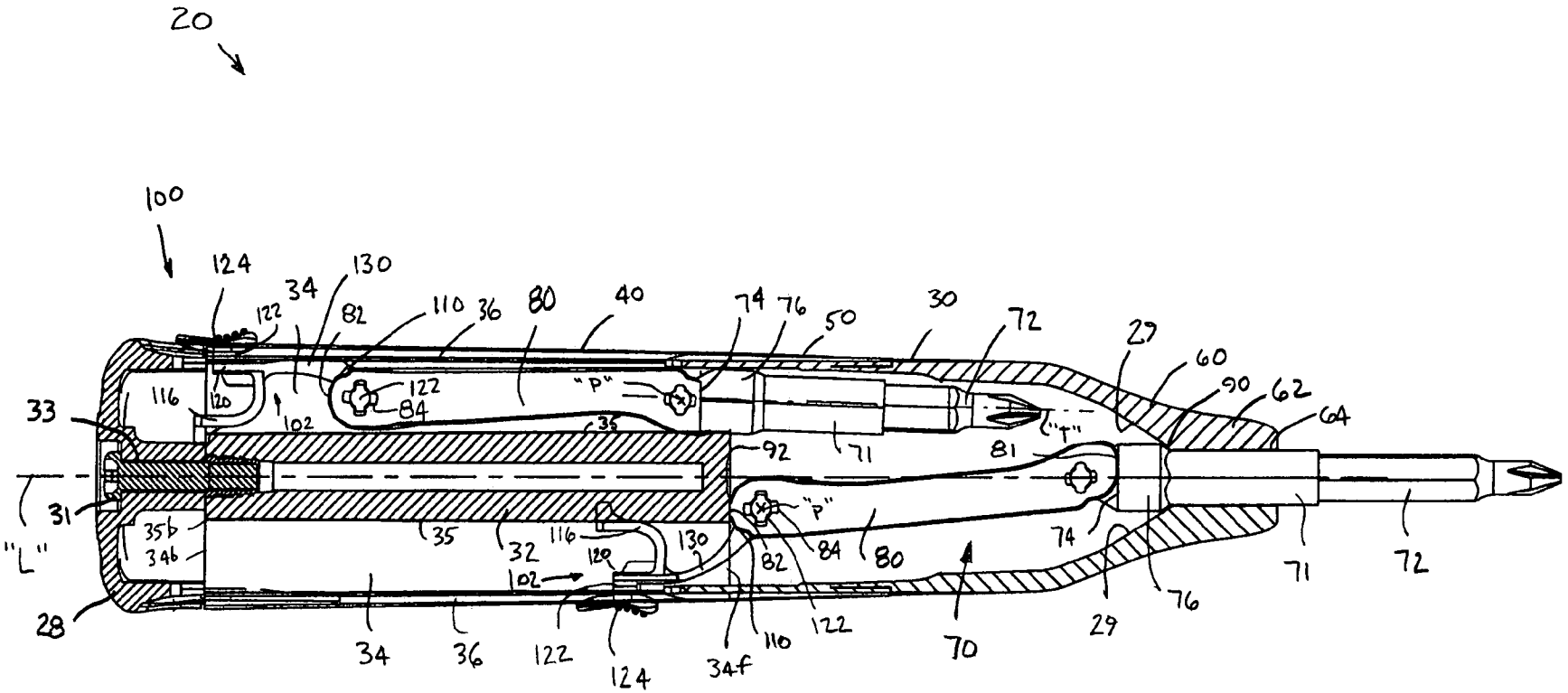
FIG. 6 is a cross-sectional side elevational view similar to FIG. 5, but showing one bit assembly in a forwardly extended in-use configuration.
Figure 7:
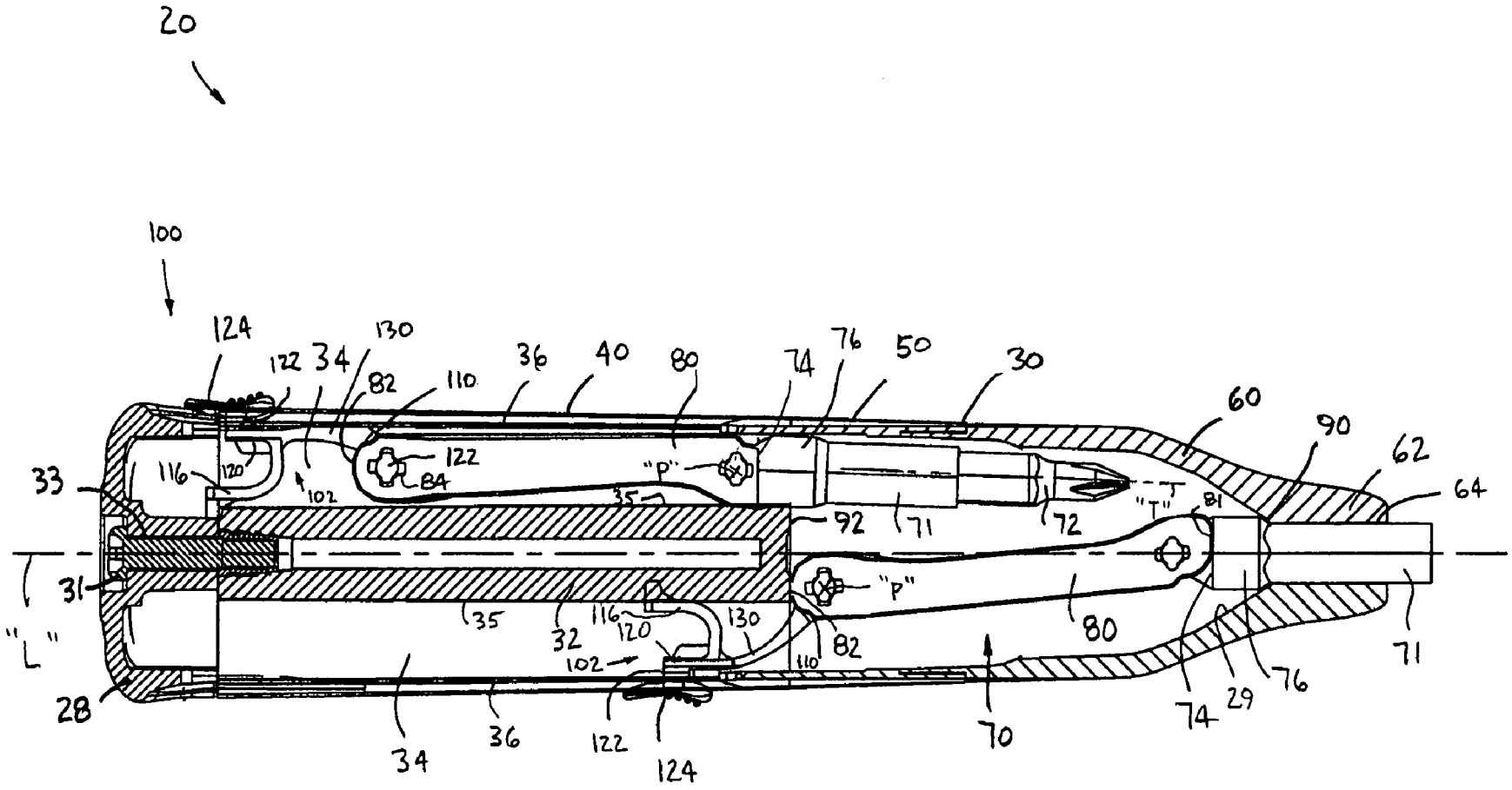
FIG. 7 is a cross-sectional side elevational view similar to FIG. 6, but with the tool bit member removed from the base portion of the bit assembly.
Figure 8:
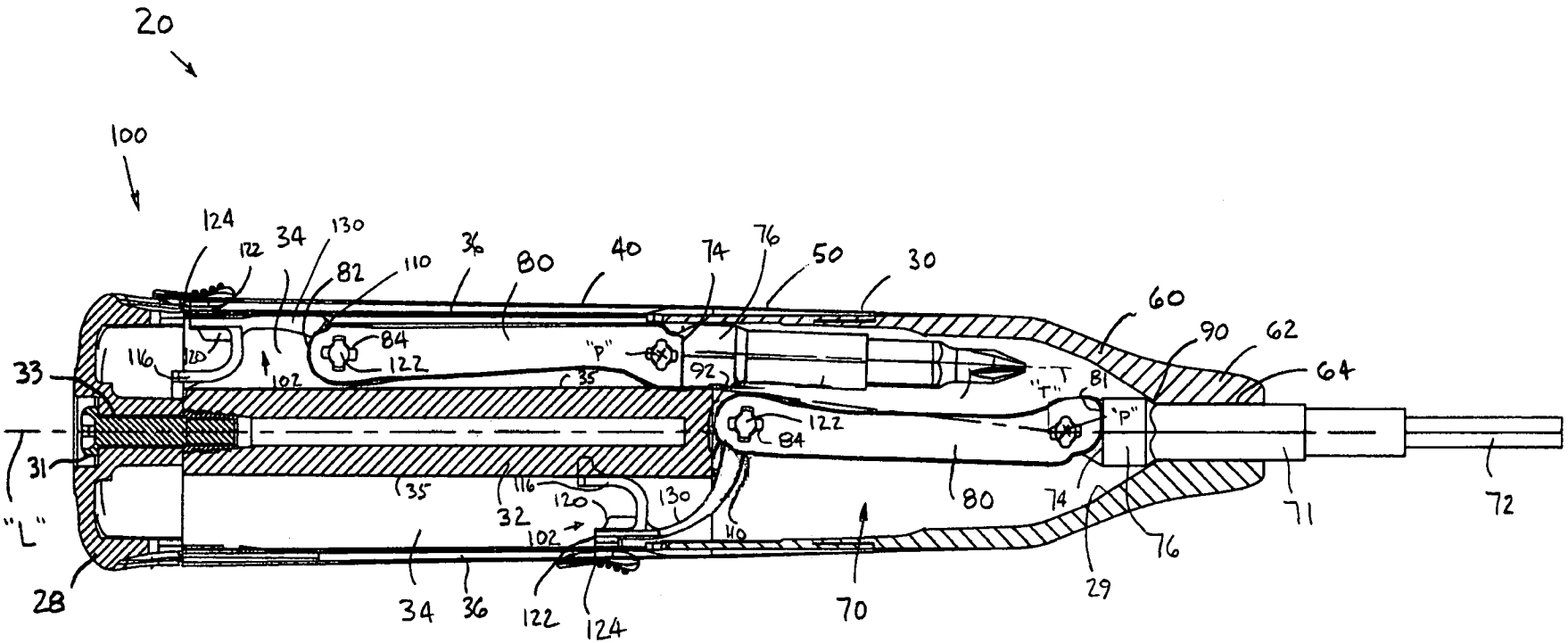
FIG. 8 is a cross-sectional side elevational view similar to FIG. 6, but with another tool bit member installed in the base portion of the bit assembly.
Figure 9:
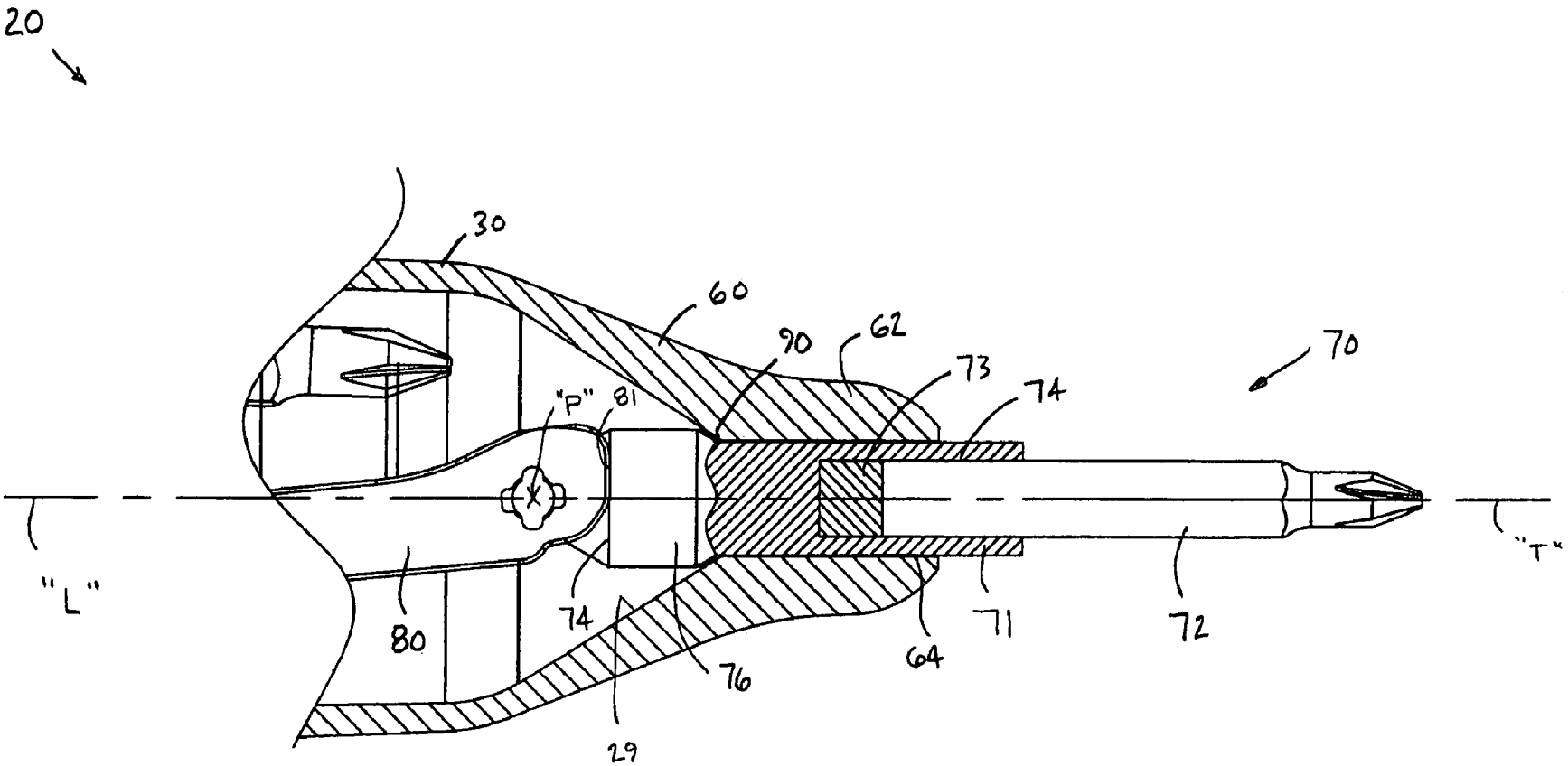
FIG. 9 is an enlarged cut-away side elevational view of a portion of the first preferred embodiment multi-bit driver of FIG. 6.

At least one of the bit assemblies 70, and in the first preferred embodiment as illustrated, all of the bit assemblies 70, have a base portion 71 and a tool bit member 72. Each tool bit member 72 is removably and replaceably mountable in a corresponding base portion 71 by means of a magnet 73 mounted in the base portion 71. As can be best seen in FIGS. 5 and 9, a tool bit member 72 is mounted within the base portion 71. As can be best seen in FIG. 9, the base portion 71 of the bit assembly 70 has a hexagonal recess 74 with the magnet 73 secured in place at the bottom of the hexagonal recess 73. The tool bit member 72 is shaped and dimensioned to slide into and out of the hexagonal recess 74, yet fit securely in the hexagonal recess 74 such that the tool bit member 72 is rotated by the base portion 71. As can be seen in FIGS. 3 and 7, the tool bit 71 has been removed from the base portion 71. As can be seen in FIGS. 4 and 8, a new tool bit 71 has been mounted in the base portion 71, and is retained there in removable and replaceable relation by the magnet 73. In this manner, the tool bit member 72 is removably and replaceably mountable on the base portion 71. Accordingly, the multi-bit driver 20 can present any type of tool bit member 72 for use, whether it be a screwdriver bit, a drill bit, an allen key bit, and so on.

There is means on the housing 30 for receiving the tool bits 72 singularly, or in other words one at a time, in torque transmitting relation. In the preferred embodiment, as illustrated, the means for receiving the tool bit members 72 comprises a bit chuck 62 disposed at one end of the housing 30 and integrally formed within the housing 30 specifically with the cone portion 60, so as to be substantially solid. The bit chuck 62 includes a bit-receiving opening 64 for permitting the tool bit members 72 singularly to extend therethrough. The bit-receiving opening 64 is lengthy enough along the longitudinal axis AL@ and is of suitable dimension to retain a tool bit member 72 received therein substantially aligned with the longitudinal axis AL@. In the above described manner, when the handle portion 40 of the housing 30 is turned by a user, torque is transmitted from the housing 30 to the tool bit members 72, thus causing the tool bit members 72 to turn with the housing 30.

The housing 30 also comprises a rearward facing abutment surface 90 disposed within said housing 30, preferably on the cone portion 60 adjacent the bit chuck 62. The rearward facing abutment surface 90 receives a portion of the overmolded plastic back end portion 76 thereagainst, as will be discussed in greater detail subsequently.

A forward facing abutment surface 92 is disposed within the housing 30, preferably on the central column 32. The forward facing abutment surface 92 receives the contact surface 82 of the bit extension 80 thereagainst, as will be discussed in greater detail subsequently.

An actuator means, as indicated by the general reference numeral 100, extends from each bit assembly 70 exteriorly to the housing 30 for operative engagement by a user. In the preferred embodiment, as illustrated, each actuator means comprises a flexible actuator member 102. Each actuator member 102 comprises a unitary molded plastic piece and has an attachment portion 110 and a mounting portion 120 connected together by a flexible connector portion 130. The flexible connector portion 130 may be resiliently flexible so as to return to its original shape. The flexible actuator member 102 does need to be sufficiently rigid to be able to push the attachment portion 110 laterally so as to move the back end 86 of the bit extension 80 in a lateral direction onto the abutment surface on the central column 32.

Each actuator member 102 is operatively attached in hinged relation to a co-operating bit assembly 70 at the attachment portion 110. In the preferred embodiment, as illustrated, each actuator member 102 is operatively attached in pivoting relation to a co-operating bit assembly 70 by means of a small pin portion 122 projecting laterally outwardly from the attachment portion 110. The small pin portion 122 extends through a co-operating aperture 84 in the bit extension 80 adjacent the back end 86 thereof. Alternatively, a living hinge arrangement could be used to operatively attach the actuator member 102 in hinged relation to a co-operating bit assembly 70.

The mounting portion 120 comprises a stem portion 122 that extends through a slot 36 and terminates at a button portion 124 disposed exteriorly to the housing 30. In this manner, the actuator member 102 is mounted in slidable relation within a slot 36 that is oriented longitudinally along the housing 30.

The button portion 124 is preferably slightly concavely shaped and optionally has formed therein a representation 106 of the shape of the attached tool bit member 72, in order to make possible the identification of a desired tool bit member 72 when it is in the housing 30. It should be understood that the representation 106 would only properly represent one type of tool bit member 72, and that when a tool bit member 72 is changed, the representation may be incorrect. Accordingly, the button portion for each of the tool bit members 72 that is interchangeable, might not include a representation 106.

Each actuator member 102 further comprises a flexible biasing arm 116 projecting outwardly from the mounting portion 120 for biased engagement with the central column 32. In this manner, the actuator member 102 is frictionally retained within the slot 36 for controlled sliding movement, in order to minimize looseness and play.

The actuator member 102 extends from a bit assembly 70 exteriorly to the housing 30, as aforesaid, for co-operative movement of the actuator member 102 and the bit assembly 70 between a retracted configuration, and a forwardly extended in-use configuration, and back to the retracted configuration. There is also a forwardly extended intermediate configuration between the retracted configuration and the forwardly extended in-use configuration.

In the retracted configuration, the bit assemblies 70 are retained within the housing 30. In the forwardly extended intermediate configuration, the tool bit member 72 extends partially outwardly from the housing 30. Further, the overmolded plastic back end portion 76 on the bit assembly 70 contacts the rearward facing abutment surface 90 on the cone portion 60, which contact limits the forward motion of the bit assembly 70. Further forward sliding movement of the actuator member 102, as accommodated by the flexible actuator member 102, causes the bit assembly 70 to move to its forwardly extended in-use configuration. More specifically, the forward movement of the user engageable button portion 124 on the mounting portion 120 of the flexible actuator member 102 causes flexible connector portion 130 to move the attachment portion 110 to the end of the channel 34. Accordingly, the contact surface 82 of the bit extension 80 is removed from the channel 34. At that point, the flexible connector portion 130 pushes the attachment portion 110 laterally so as to move the back end 86 of the bit extension 80 in a lateral direction onto the abutment surface on the central column 32. The bit assembly 70 is then in its forwardly extended in-use configuration whereat the bit assembly 70 is positioned such that the tool bit member 71 extends outwardly from the housing 30 through the bit receiving opening 64 of the bit chuck 62.

In the forwardly extended in-use configuration, the contact surface 82 of the bit extension 80 of the bit assembly 70 is disposed in longitudinal force transmitting engagement against the forward facing abutment surface 92 on the central column 32, to preclude rearward movement of the bit assembly 70 due to substantially longitudinally directed forces transmitted from the tool bit 72. Preferably, the contact surface 82 of the bit extension 80 moves slightly past the center of the contact surface 82 of the bit extension 80. In this manner, the rearwardly directed forces transmitted from the tool bit member 72 ultimately to the forward facing abutment surface 92 on the central column 32, as will be discussed in greater detail subsequently, cause the contact surface 82 of the bit extension 80 to pull laterally against the flexible connector portion 130 of the flexible actuator member 102; however, the flexible actuator member 102 has reached the front end of the slot 36, thus keeping the contact surface 82 of the bit extension 80 in place on the forward facing abutment surface 92. In this manner, the forward facing abutment surface 92 and the central column 32 provide means to retain the bit assemblies in their forwardly extended in-use configuration.

Rearwardly directed longitudinal forces are transmitted from the tool bit 72, through the first stop surface 74 on the tool bit 72, to the second stop surface 81 on the bit extension 80, through the bit extension 80, to the contact surface 82 on the bit extension 80 and to the forward facing abutment surface 92 on the central column 32.

Further, in the forwardly extended in-use configuration, the contact surface 82 of the bit extension 80 disposed in longitudinal force transmitting engagement against the forward facing abutment surface 92, and the bit assembly 70, in contact with the rearward facing abutment surface 90. Accordingly, the overmolded plastic back end portion 76 is compressed slightly so as to ensure that the bit assembly 70 is retained snugly between the forward facing abutment surface 92 and the rearward facing abutment surface 90.

The actuator member 102 and the bit assembly 70 then move back to the retracted configuration in the following manner. The contact surface 82 of the bit assembly 70 is removed in a lateral direction from the longitudinal force transmitting engagement with the forward facing abutment surface 92 by means of rearward movement of the user engageable button portion 124 (mounting portion) of the flexible actuator member 102, which in turn causes the attachment portion 110 of the flexible actuator member 102 to move the back end 86 of the bit extension 80 in a lateral direction off the forward facing abutment surface 92 on the central column 32, without having to first perform a separate unlocking function.

There is also a longitudinal channel 34 for each bit assembly 70, and each longitudinal channel 34 has a longitudinal guide surface 35. The longitudinal channel 34 and longitudinal guide surface 35 each have a front end 34*f*, 35*f*, respectively, and a back end 34*b*, 35*b*, respectively. The forward facing abutment surface 92 on the central column 32 is disposed at the front end of each longitudinal channel 34 and each longitudinal guide surface 35, and is oriented substantially transversely to each longitudinal channel 34 and each longitudinal guide surface 35.

In use, each bit assembly 70 slides along its longitudinal channel 34 with at least part of the bit assembly 70 sliding along the longitudinal guide surface 35, between the retracted configuration and the forwardly extended in-use configuration, specifically before the forwardly extended intermediate configuration. When the back end 86 of the bit extension 80 reaches the front end 34*f* of the longitudinal channel 34 and the front end 35*f* of the longitudinal guide surface 35, the back end 86 of the bit extension 80 is moved in a lateral direction over the abutment surface on the central column 32, to essentially Alock@ the bit assembly 70 in place. This function happens automatically as the bit assembly 70 is moved forwardly into its forwardly extended in-use configuration. Accordingly, moving a bit assembly 70 from its retracted configuration to its forwardly extended in-use configuration is a one step process.

The housing 30 further comprises a tool bit directing portion 29. The tool bit directing portion 29 comprises a ramp disposed between the front end of the longitudinal channel 34 and the bit chuck 62. When a tool bit 72 slidingly contacts the ramp 29, as it moves from its retracted configuration towards its forwardly extended in-use configuration, the tool bit 72 is directed towards the bit-receiving opening 64 in the bit chuck 62, thus helping the tool bit 72 to subsequently enter the bit-receiving opening 64. The tool bit 72 also typically deflects off the cone portion 60 of the housing 30 adjacent the bit-receiving opening 64 in the bit chuck 62, in order to help guide the tool bit 72 into the bit-receiving opening 64.

The bit chuck 62 aligns the tool bit 72 along the longitudinal axis AL@. The contact surface 82 of the bit assembly 70 is disposed in longitudinal force transmitting engagement against the abutment surface, slightly past (or over) the longitudinal axis AL@ with respect to the actuator means. Accordingly, the tool bit axis AT@ would be oriented at slight angle with respect to the longitudinal axis AL@. This type of function is commonly referred to as over-the-centre, helps ensure that the rearwardly directed longitudinal forces do not push the back end 86 of the bit extension 80 off the forward facing abutment surface 92, thus providing proper operation of the multi-bit driver against even strong rearwardly directed longitudinal forces from the tool bit 72.

Reference will now be made to FIG. 10, which shows a second preferred embodiment of the multi-bit driver according to the present invention, as indicated by the general reference numeral 220. The second preferred embodiment multi-bit driver 220 is similar to the first preferred embodiment multi-bit driver 20 except that the magnet 273 is in the tool bit member 272.

Reference will now be made to FIG. 11, which shows a third preferred embodiment of the multi-bit driver according to the present invention, as indicated by the general reference numeral 320. The third preferred embodiment multi-bit driver 320 is similar to the first preferred embodiment multi-bit driver 20 except that the base portion 371 portion of each bit assembly 370 comprises a magnetic material so as to retain said tool bit member 372 in place on said base portion 371 of the respective bit assembly 370.

Reference will now be made to FIG. 12, which shows a fourth preferred embodiment of the multi-bit driver according to the present invention, as indicated by the general reference numeral 420. The fourth preferred embodiment multi-bit driver 420 is similar to the first preferred embodiment multi-bit driver 20 except that the tool bit member 472 comprises a magnetic material so as to retain said tool bit member 472 in place on said base portion 471 of the respective bit assembly 470.

Reference will now be made to FIG. 13, which shows a fifth preferred embodiment of the multi-bit driver according to the present invention, as indicated by the general reference numeral 520. The fifth preferred embodiment multi-bit driver 520 is similar to the first preferred embodiment multi-bit driver 20 except that there is only one of the bit assemblies 570 has a base portion 571 and a tool bit member 572 removably and replaceably mountable on said base portion 571.

Reference will now be made to FIG. 14, which shows a sixth preferred embodiment of the multi-bit driver according to the present invention, as indicated by the general reference numeral 620. The sixth preferred embodiment multi-bit driver 620 is similar to the first preferred embodiment multi-bit driver 20 except that the tool bit member 672 is removably and replaceably mountable on the base portion 671 of the respective bit assembly 670 by means of a ball bearing 690 biased by a spring member 692 retained within a recess 693, into an annular channel 673 on the tool bit member 672.

Reference will now be made to FIGS. 15 and 16, which show a seventh preferred embodiment of the multi-bit driver according to the present invention, as indicated by the general reference numeral 720. The seventh preferred embodiment multi-bit driver 720 is similar to the first preferred embodiment multi-bit driver 20 except that the base portion 771 of the bit assembly 770 is shaped and dimensioned to receive a standard size tool bit member 772. More specifically, as can be best seen in FIG. 16, the base portion 771 of the bit assembly 770 has a hexagonal recess 774 with a thin magnet 773 secured in place at the bottom of the hexagonal recess 774. The tool bit member 772 is shaped and dimensioned to slide into and out of the hexagonal recess 774, yet fit securely in the hexagonal recess 774 such that the tool bit member 772 is rotated by the base portion 771. In this manner, the tool bit member 772 is removably and replaceably mountable on the base portion 771. Accordingly, conventional size tool bits can be used with the multi-bit driver of the present invention.

As can be understood from the above description and from the accompanying drawings, the present invention provides a multi-bit driver that is not limited as to the number of driver bits it can present for use, which feature is unknown in the prior art.

Other variations of the above principles will be apparent to those who are knowledgeable in the field of the invention, and such variations are considered to be within the scope of the present invention. Further, other modifications and alterations may be used in the design and manufacture of the multi-bit driver of the present invention without departing from the spirit and scope of the accompanying claims.

We claim:

1. A multi-bit driver comprising: a housing;

a plurality of bit assemblies operatively retained within said housing, each bit assembly having a tool bit member, and wherein at least one of said plurality of bit assemblies has a base portion and a tool bit member removably and replaceably mountable on said base portion; a bit chuck disposed at one end of said housing for receiving each tool bit member singularly in torque transmitting relation, and including a bit-receiving opening for permitting each tool bit member singularly to extend therethrough; actuator means extending from each said bit assembly exteriorly to said housing for operative engagement by a user, for co-operative movement of said actuator means and said bit assembly between a retracted configuration, a forwardly extended in-use configuration whereat said bit assembly is positioned such that said tool bit member extends outwardly from said housing through said opening of said bit chuck, and back to said retracted configuration; and, means to retain said bit assemblies in said forwardly extended in-use configuration, wherein said means to retain the bit assemblies in the forwardly extended in-use configuration comprises a central column in said housing, said central column having a forwardly facing abutment surface for receiving said base portion of said bit assemblies thereagainst.

2. The multi-bit driver of claim 1, wherein said tool bit member is removably and replaceably mountable on said base portion of the respective bit assembly by means of a magnet.

3. The multi-bit driver of claim 2, wherein said magnet is mounted on said base portion.

4. The multi-bit driver of claim 2, wherein said magnet is mounted on said tool bit member.

5. The multi-bit driver of claim 1, wherein said base portion of each bit assembly comprises a magnetic material so as to retain said tool bit member in place on said base portion of the respective bit assembly.

6. The multi-bit driver of claim 1, wherein said tool bit member of each bit assembly comprises a magnetic material so as to retain said tool bit member in place on said base portion of the respective bit assembly.

7. The multi-bit driver of claim 1, wherein each said bit assembly further comprises a bit extension attached to said base portion.

8. The multi-bit driver of claim 7, wherein each said bit extension is operatively attached in hinged relation to said tool bit.

9. The multi-bit driver of claim 8, wherein each said bit extension is pivotally attached to said tool bit.

10. The multi-bit driver of claim 8, wherein each said bit assembly has a tool bit with a first stop surface and a bit extension with a second stop surface and defining a longitudinal axis, wherein said tool bit is pivotally attached to said bit extension for pivotal movement about a pivot axis oriented substantially transversely to said longitudinal axis between an oblique angular position and a forward-oriented angular position whereat said first and second stop surfaces abut against each other.

11. The multi-bit driver of claim 8, wherein each said tool bit comprises an overmolded plastic back end portion, and said tool bit is pivotally attached at said overmolded plastic back end portion to said bit extension.

12. The multi-bit driver of claim 1, wherein each actuator means comprises an actuator member.

13. The multi-bit driver of claim 12, wherein each actuator member is operatively attached in hinged relation to a co-operating bit assembly.

14. The multi-bit driver of claim 13, wherein each actuator member is operatively attached in pivoting relation to a cooperating bit assembly.

15. The multi-bit driver of claim 14, wherein each said actuator member comprises an attachment portion and a mounting portion connected together by a flexible connector portion.

16. The multi-bit driver of claim 15, wherein said flexible connector portion is resiliently flexible.

17. The multi-bit driver of claim 16, wherein each said flexible connector portion comprises a button portion disposed exteriorly to said housing.

18. The multi-bit driver of claim 1, wherein each actuator member comprises a unitary molded plastic piece.

19. The multi-bit driver of claim 1, wherein each said actuator member is mounted in slidable relation within a slot in said housing.

20. The multi-bit driver of claim 19, wherein each said slot is oriented longitudinally along said housing.

21. The multi-bit driver of claim 1, wherein said bit chuck is integrally formed within said housing.

22. The multi-bit driver of claim 1, wherein said housing further comprises a tool bit directing portion.

23. The multi-bit driver of claim 1, wherein said bit chuck aligns said tool bit along said longitudinal axis and said contact surface of said bit assembly is disposed in longitudinal force transmitting engagement against said abutment surface over said longitudinal axis with respect to said actuator means.

24. The multi-bit driver of claim 1, wherein said plurality of bit assemblies comprises six bit assemblies.

25. The multi-bit driver of claim 1, wherein only one of said bit assemblies has a base portion and a tool bit member removably and replaceably mountable on said base portion.

26. The multi-bit driver of claim 1, wherein all of said bit assemblies has a base portion and a tool bit member removably and replaceably mountable on said base portion.

* * * * *